US011187073B2

(12) United States Patent
Haubold et al.

(10) Patent No.: US 11,187,073 B2
(45) Date of Patent: Nov. 30, 2021

(54) METHOD AND APPARATUS FOR BENDING DECOUPLED ELECTRONICS PACKAGING

(71) Applicant: BAKER HUGHES INCORPORATED, Houston, TX (US)

(72) Inventors: Carsten Haubold, Celle (DE); Joachim Treviranus, Winsen (DE); Tim Mueller, Burgwedel (DE); Andreas Peter, Niedersachsen (DE)

(73) Assignee: BAKER HUGHES HOLDINGS LLC, Houston, TX (US)

( * ) Notice: Subject to any disclaimer, the term of this patent is extended or adjusted under 35 U.S.C. 154(b) by 0 days.

(21) Appl. No.: 15/229,810

(22) Filed: Aug. 5, 2016

(65) Prior Publication Data

US 2018/0038217 A1 Feb. 8, 2018

(51) Int. Cl.
*E21B 47/017* (2012.01)
*E21B 17/20* (2006.01)

(52) U.S. Cl.
CPC ..... *E21B 47/017* (2020.05); *E21B 17/20* (2013.01)

(58) Field of Classification Search
CPC ..... E21B 17/006; E21B 17/02; E21B 17/20; E21B 47/011; E21B 7/04; E21B 7/043; E21B 7/046; E21B 7/06
See application file for complete search history.

(56) References Cited

U.S. PATENT DOCUMENTS 3,149,490 A * 9/1964 Havlik ..... E21B 47/011 175/41
5,320,169 A * 6/1994 Delatorre ..... E21B 17/07 166/113
5,507,348 A * 4/1996 Van Steenwyk ..... E21B 23/02 166/117.6
6,102,122 A * 8/2000 de Rouffignac ..... E21B 36/04 166/302
6,714,870 B1 * 3/2004 Weston ..... E21B 47/022 702/9
2004/0219362 A1 * 11/2004 Wort ..... A61F 2/30767 428/408
2010/0032161 A1 * 2/2010 Peter ..... E21B 47/017 166/302

(Continued)

FOREIGN PATENT DOCUMENTS

JP 2003182594 A * 7/2003
JP 2003182594 A 7/2003
WO 2015175296 11/2015

OTHER PUBLICATIONS

PCT/US2017/045482—International Search Report dated Nov. 9, 2017.

(Continued)

*Primary Examiner* — Robert E Fuller
*Assistant Examiner* — Lamia Quaim
(74) *Attorney, Agent, or Firm* — Mossman Kumar & Tyler PC

(57) ABSTRACT

An apparatus for protecting an electronics module used in a borehole may include an enclosure disposed along a drill string. The electronics module may be attached to the enclosure by at least one joint. The at least one joint allows a predetermined bending between the electronics module and the enclosure that does not mechanically overload the electronics module. In some embodiments, the joint may be a ball joint.

20 Claims, 2 Drawing Sheets

(56) References Cited

U.S. PATENT DOCUMENTS

| | | | | |
|---|---|---|---|---|
| 2012/0043133 | A1* | 2/2012 | Millet | E21B 7/067 175/55 |
| 2013/0206401 | A1* | 8/2013 | Bhoite | E21B 47/00 166/255.1 |
| 2013/0235537 | A1* | 9/2013 | Swett | H05K 5/0213 361/752 |
| 2014/0124269 | A1 | 5/2014 | Logan et al. | |
| 2015/0252666 | A1 | 9/2015 | Wang et al. | |
| 2015/0267481 | A1 | 9/2015 | Logan et al. | |
| 2015/0275652 | A1 | 10/2015 | Fanini et al. | |

OTHER PUBLICATIONS

PCT Application No. PCT/US2017/045482—International Search Report dated Nov. 9, 2017.

* cited by examiner

METHOD AND APPARATUS FOR BENDING DECOUPLED ELECTRONICS PACKAGING

FIELD OF THE DISCLOSURE

This disclosure pertains generally to devices and methods for providing shock and vibration protection for borehole devices.

BACKGROUND OF THE DISCLOSURE

Exploration and production of hydrocarbons generally requires the use of various tools that are lowered into a borehole, such as drilling assemblies, measurement tools and production devices (e.g., fracturing tools). Electronic components may be disposed downhole for various purposes, such as control of downhole tools, communication with the surface and storage and analysis of data. Such electronic components typically include printed circuit boards (PCBs) that are packaged to provide protection from downhole conditions, including temperature, pressure, vibration and other thermo-mechanical stresses.

Some high temperature electronics are built using ceramic materials as the substrate on which individual electronic parts are attached. These ceramic materials can be damaged by bending moment acting on them. Such bending can occur when a drilling tool is used to drill a curved section of a borehole. Because the curvatures of the drilling tool and the bore hole can be substantially the same, the electronics inside the drilling tool may be forced to bend to accommodate the same curvature as well. During drilling, the drilling tool rotates inside the curved borehole section. Thus, the drilling tool and the electronics inside the drilling tool are subjected to undesirable cyclical bending.

In one aspect, the present disclosure addresses the need for enhanced electronic components and other bending moment sensitive devices used in a borehole.

SUMMARY OF THE DISCLOSURE

In aspects, the present disclosure provides an apparatus for protecting an electronics module used in a borehole. The apparatus may include an enclosure disposed along a drill string. The electronics module may be attached to the enclosure by at least one joint. The at least one joint allows a predetermined bending between the electronics module and the enclosure that does not mechanically overload the electronics module. In some embodiments, the joint may be a ball joint.

In aspects, the present disclosure also provides a method for protecting an electronics module used in a borehole. The method may include forming a drill string; disposing an enclosure along the drill string, wherein the electronics module is attached to the enclosure by at least one joint; and protecting the electronics module by using the at least one joint to allow a predetermined bending between the electronics module and the enclosure without mechanically overloading the electronics module.

Examples of certain features of the disclosure have been summarized rather broadly in order that the detailed description thereof that follows may be better understood and in order that the contributions they represent to the art may be appreciated.

BRIEF DESCRIPTION OF THE DRAWINGS

For a detailed understanding of the present disclosure, reference should be made to the following detailed description of the embodiments, taken in conjunction with the accompanying drawings, in which like elements have been given like numerals, wherein.

DETAILED DESCRIPTION

Directional drilling can result in a borehole having curvatures that impose significant bending moments on a drilling tool. These bending moments can damage certain brittle electronics in the devices and components used in a drill string. In aspects, the present disclosure provides mountings and related methods for protecting these components from mechanical overloading while being conveyed through the borehole. By mechanical overloading, it is meant bending, twisting, or otherwise deforming these components to the point that these components fracture, crack, disintegrate, or deform to a point where they become partially or completely non-functional.

Figure 1:
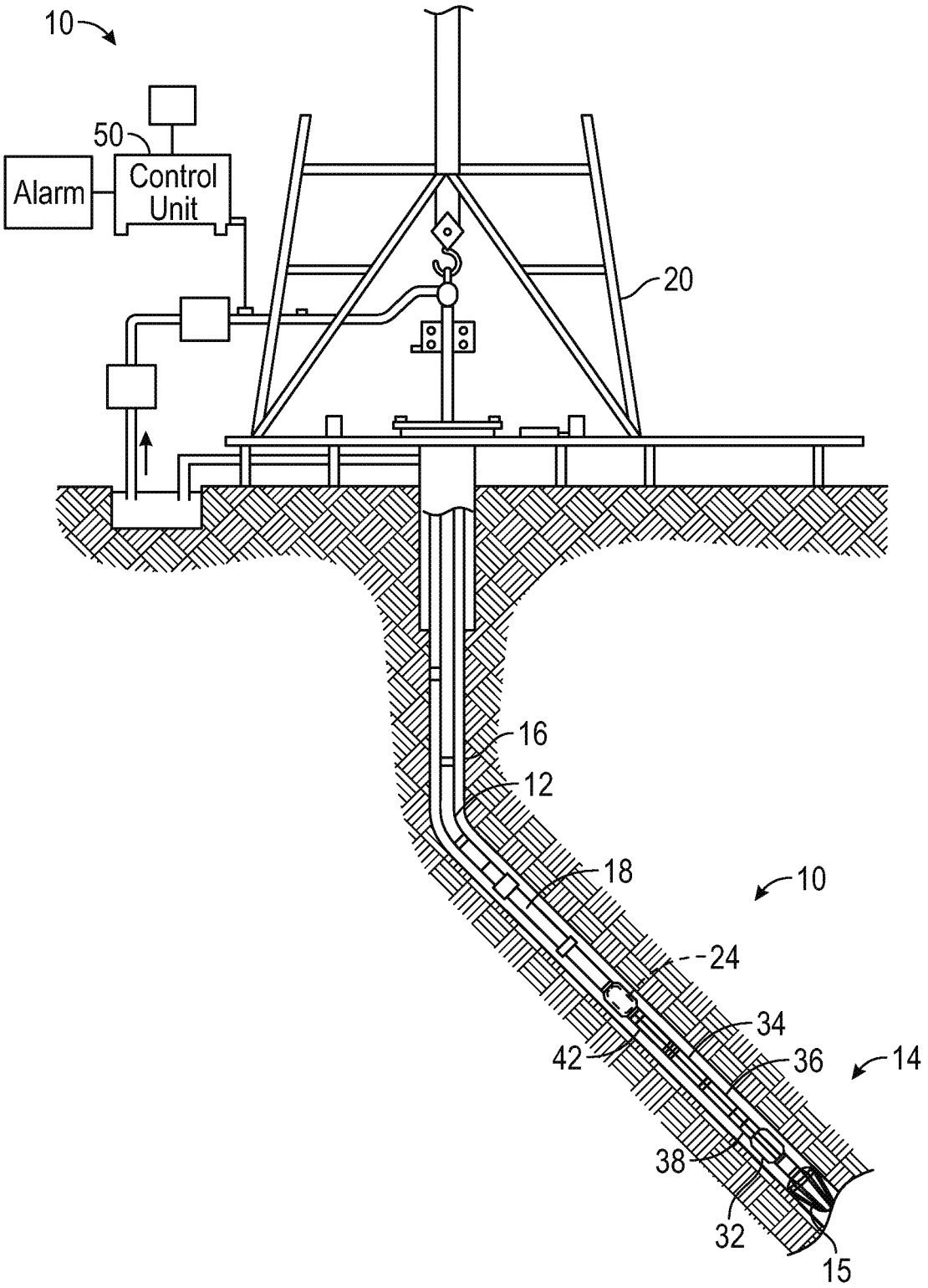
FIG. 1 shows a schematic of a well system that may use one or more mounts according to the present disclosure.

Referring now to FIG. 1, there is shown one illustrative embodiment of a drilling system 10 utilizing a borehole string 12 that may include a bottomhole assembly (BHA) 14 for directionally drilling a borehole 16. While a land-based rig is shown, these concepts and the methods are equally applicable to offshore drilling systems. The borehole string 12 may be suspended from a rig 20 and may include jointed tubulars or coiled tubing. In one configuration, the BHA 14 may include a drill bit 15, a sensor sub 32, a bidirectional communication and power module (BCPM) 34, a formation evaluation (FE) sub 36, and rotary power devices such as drilling motors 38. The sensor sub 32 may include sensors for measuring near-bit direction (e.g., BHA azimuth and inclination, BHA coordinates, etc.) and sensors and tools for making rotary directional surveys. The system may also include information processing devices such as a surface controller 50 and/or a downhole controller 42. Communication between the surface and the BHA 14 may use uplinks and/or downlinks generated by a mud-driven alternator, a mud pulser and/or conveyed using hard wires (e.g., electrical conductors, fiber optics), acoustic signals, EM or RF.

One or more electronics modules 24 incorporated into the BHA 14 or other component of the borehole string 12 may include components as necessary to provide for data storage and processing, communication and/or control of the BHA 14. These components may be disposed in suitable compartments formed in or on the borehole string 12. Exemplary electronics in the electronics module include printed circuit board assemblies (PCBA) and multiple chip modules (MCM's).

Figure 2:
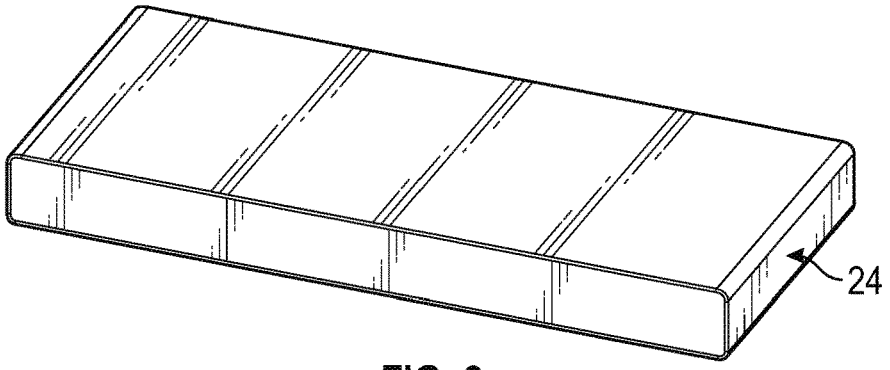
FIG. 2 illustrates one embodiment of an electronics module that may be protected using a mount according to the present disclosure.

Referring to FIG. 2, there is shown one non-limiting embodiment of a module 24 that may be used with the borehole string 12 of FIG. 1. The module 24 can be a BHA's tool instrument module, which can be a crystal pressure or temperature detection, or frequency source, a sensor acoustic, gyro, accelerometer, magnetometer, etc., sensitive mechanical assembly, MEM, multichip module MCM, Printed circuit board assembly PCBA, flexible PCB Assembly, Hybrid PCBA mount, MCM with laminate substrate MCM-L, multichip module with ceramic substrate e.g. LCC or HCC, compact Integrated Circuit IC stacked assemblies with ball grid arrays or copper pile interconnect technology, etc. All these types of modules 24 often are made with fragile and brittle components which cannot take bending and torsion forces and therefore benefit from the protection of the mounting arrangements described below.

Figure 3:
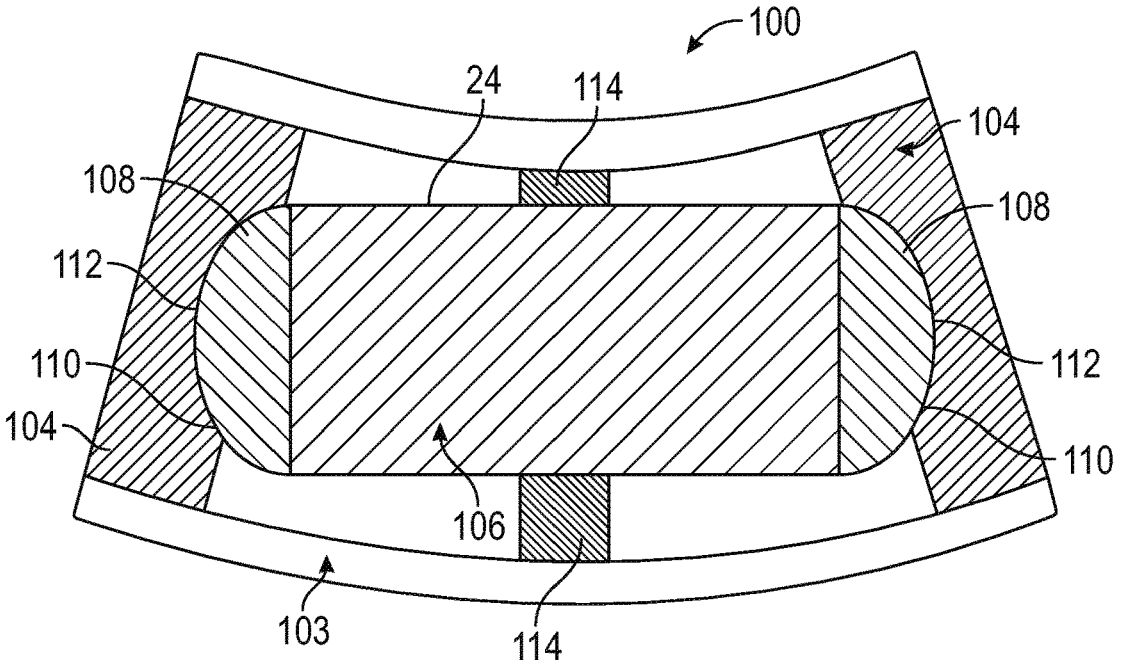
FIG. 3 illustrates a sectional view of a section of the BHA that includes a mount according to one embodiment of the present disclosure that uses a ball joint.

FIG. 3 schematically illustrates a mount 100 for protecting a module 24 (FIG. 2) from bending stresses. The mount 100 may be formed in a section 102 of the borehole string 12 of FIG. 1. For example, the section 102 may be a drill collar, a sub, a portion of a jointed pipe, or the BHA 14. The drill collar 102 may contain enclosures for electronic modules, e.g. pressure barrels 103, which will be bent to substantially the same curvature as the collar. The mount 100 may be positioned inside such an enclosure, e.g., a pressure barrel 103. The mount 100 may include one or more joints 104 that support one or more modules 24. The module 24 has opposing ends 108 that connect to the joints 104. While two joints 104 are shown, in some embodiments, one joint 104 may be used.

Generally, the joints 104 allow the section 102 and pressure barrel 103 to bend while preventing module 24 from encountering bending stresses. In one arrangement, the joints 104 may employ surfaces that allow relative rotation between the joint 104 and the ends 108. For example, the joint 104 may employ a ball-and-socket connection wherein the ends 108 have convex faces 110 that can slide inside concave supports 112. It should be noted that the concave surface member may be associated with the electronics module or the enclosure and the convex member may be associated with the electronics module or the enclosure. It should be understood that such an arrangement is merely illustrative. For example, the joint 104 may include both the ball and the socket and the ends 108 may be attached to the ball. In either case, the ball shape of such joints 104 ensures that housing bending is decoupled from the electronic component throughout the rotating bending cycle.

It should be further understood that ball-and-socket connection is only a non-limiting type of connection that may be used; e.g., a pinned joint may also be used. The socket may deviate from a spherical shape to e.g. a conical shape or only a hole, having an edge for the ball to slide on, which provides for simpler manufacturing but increases contact pressure. The ball, the socket or both may be made from a variety of materials in order to minimize friction and wear. Suitable materials include, but are not limited to steel, a copper alloy, a bronze, aluminum, ceramic, tungsten carbide or a polymer. The goal of minimizing friction and wear may be achieved by application of coatings to the members of joint 104. Such coatings include, but are not limited to PTFE, diamond, graphite and PEEK. In some embodiments, the ball joint may use a non-spherical socket, e.g., conical, oval, etc. Also the socket may be a suitably sized hole.

In embodiments, the joints 104 may be configured to provide support for the mass of the electronic component under shock and vibration. The joints 104 may be mechanical preloaded, e.g., spring loaded, hydraulically pressurized, utilize elastomeric elasticity, and/or utilize metal spring force or a combination thereof in order to compensate for manufacturing tolerances and thermal expansion mismatches. The electronic component may be supported by additional members (not shown) to avoid rotation inside the enclosure, e.g., the pressure barrel 103.

In embodiments, the module 24 may be of a rectangular outer shape, positioned inside a larger rectangular section of the enclosure 103. The rectangular shape is only illustrative and other complementary shapes may be used. A gap between the module 24 and the wall of the enclosure 103 may be at least partially filled with elastomer elements 114. The elastomer elements 114 may also provide heat transfer away from the electronic component in order to limit self heating under electrical load. One non-limiting embodiment of elastomer elements 114 may be formed at least partially of a visco-elastic material. As used herein, a viscoelastic material is a material having both viscous and elastic characteristics when undergoing deformation.

Figure 4:
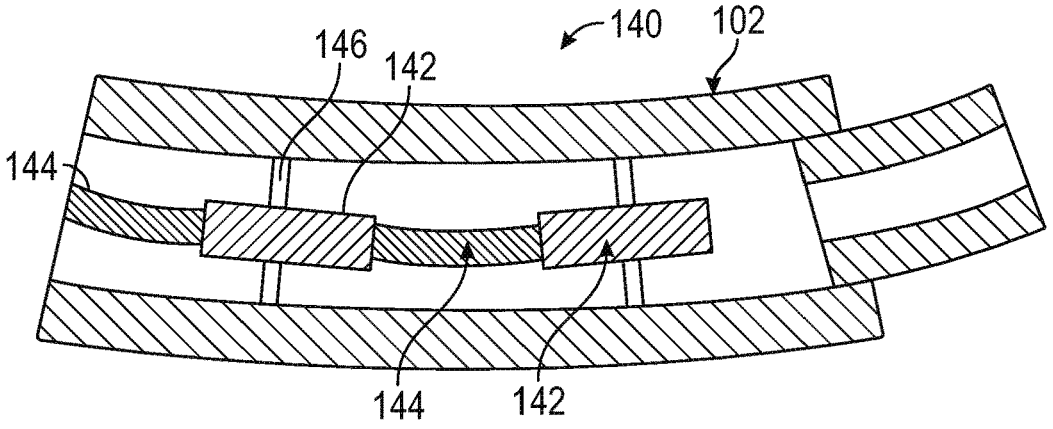
FIG. 4 illustrates a latching arrangement that may be used with a mount according to one embodiment of the present disclosure that uses flexible sections.

FIG. 4 sectionally illustrates another embodiment of a mount 140 that may be used to protect the module 24 from bending moments caused by flexure of the drill string 12. The mount 140 may include a rigid section 142 that is connected to one or more flexible sections 144 that may be considered joints. The rigid section 142 may be probe segments. The module 24 may be affixed to the rigid section 142. As noted previously, the module 24 may include brittle materials that may be damaged when flexed. Therefore, the rigid section 142 provides a platform that is sufficiently rigid to prevent physical deformation or other types of bending from being transferred to the module 24. The flexible sections 144 are joints that connect the rigid section 142 to the remainder of the drill string 12. The flexible sections 144 are constructed to bend a greater amount than the rigid section 142 for the same applied forces. In some embodiments, the flexible sections 144 may be formed of a material that is different from the material of the rigid section 142. In other embodiments, the flexible section 144 may use ball joints, splines, or other connections that allows a predetermined deflection or bend radius uphole and/or downhole of the module 24. One or more probe retention members 146 may be used to support or suspend the module 24. While FIG. 4 shows a flexible section 144 uphole and downhole of the rigid section 142, other embodiments may include only one flexible section 144, which may be uphole or downhole of the rigid section 142.

In embodiments, the elastomer elements 114 of FIG. 3 or the probe retention members 146 of FIG. 4 may be constructed as restrictors that restrict the motion of the module 24 in a rotational direction about a longitudinal axis of the module. Suitable restrictors can include elastomeric members that have suitable elasticity, spring members that apply spring force, and/or contacting surfaces that use frictional forces.

Referring now to FIGS. 1-4, during drilling, the section 102 may encounter a curvature formed along the borehole 16. Advantageously, the mounts 100, 140 allow the section 102 to bend while allowing the module 24 to remain substantially isolated from this bending. With the FIG. 3 embodiment, the bending occurs at the same location of the module 24. With the FIG. 4 embodiment, the bending occurs either immediately uphole and/or immediately downhole of the module 24. In other case, the module 24 is isolated from the physical deformation of the surrounding drill string 12.

While the foregoing disclosure is directed to the one mode embodiments of the disclosure, various modifications will be apparent to those skilled in the art. It is intended that all variations be embraced by the foregoing disclosure.

We claim:

1. An apparatus for protecting an electronics module used in a borehole, comprising:

a drill string; and an enclosure disposed along the drill string, wherein the electronics module is attached to the enclosure by at least one joint, the at least one joint being configured to allow a predetermined bending of the enclosure from flexure of the drill string, wherein the predetermined bending of the enclosure does not mechanically overload the electronics module, wherein each of the at least one joint and the electronics module comprise a surface that rotate relative to one another in response to the predetermined bending of the enclosure from flexure of the drill string.

2. The apparatus of claim 1, wherein the at least one ball joint is mechanically preloaded to compensate for at least one of: manufacturing tolerances and thermal expansion mismatches.

3. The apparatus of claim 2, wherein the preload is created by one of hydraulic pressure, rubber elasticity, metal spring force or a combination thereof.

4. The apparatus of claim 1, wherein the at least one joint includes a convex member and the electronics module includes a concave member.

5. The apparatus of claim 1, wherein the at least one joint includes a concave member and the electronics module includes a convex member.

6. The apparatus of claim 1, wherein the joint includes a non-spherical socket.

7. The apparatus of claim 1, wherein a restrictor restricts motion of the electronics module in a rotational direction about a longitudinal axis of the electronics module.

8. The apparatus of claim 7, wherein the restrictor uses at least one of: rubber elasticity, metal spring force, and friction.

9. The apparatus of claim 1, wherein the at least one joint is made at least partially of at least one of: steel, a copper alloy, a bronze, aluminum, ceramic, tungsten carbide, and a polymer.

10. The apparatus of claim 1, wherein at least a portion of the at least one joint is coated with at least one of: PTFE, diamond, graphite and PEEK.

11. A method for protecting an electronics module used in a borehole, comprising:

forming a drill string;

disposing an enclosure along the drill string, wherein the electronics module is attached to the enclosure by at least one joint; and protecting the electronics module by using the at least one joint to allow a predetermined bending of the enclosure caused by flexure of the drill string without mechanically overloading the electronics module, wherein each of the at least one joint and the electronics module comprise a surface that rotate relative to one another in response to the predetermined bending of the enclosure from flexure of the drill string.

12. The method of claim 11, further comprising mechanically preloading the at least one joint.

13. The method of claim 11, further comprising conveying the drill string through a curved section of the borehole.

14. The apparatus of claim 1, wherein the at least one joint decouples the bending of the enclosure from the electronics module.

15. The apparatus of claim 14, wherein the decoupling is throughout a rotating bending cycle.

16. The apparatus of claim 1, wherein the electronics module comprises one of a convex surface member and a concave surface member.

17. The apparatus of claim 1, wherein the electronics module comprises a ceramic material.

18. The method of claim 11, wherein the electronics module comprises one of a convex surface member and a concave surface member.

19. The apparatus according to claim 1, wherein the at least one joint is a ball joint.

20. The method according to claim 11, wherein the at least one joint is a ball joint.

* * * * *